US010047736B2

(12) United States Patent
Wellnitz et al.

(10) Patent No.: US 10,047,736 B2
(45) Date of Patent: Aug. 14, 2018

(54) METERING PUMP

(71) Applicant: Thomas Magnete GmbH, Herdorf (DE)

(72) Inventors: Robert Wellnitz, Kirchen (DE); Mike Heck, Derschen (DE); Axel Mueller, Siegen (DE); Michael Mueller, Hennef (DE); Andreas Monzen, Neuwied (DE)

(73) Assignee: Thomas Magnete GmbH, Herdorf (DE)

( * ) Notice: Subject to any disclaimer, the term of this patent is extended or adjusted under 35 U.S.C. 154(b) by 189 days.

(21) Appl. No.: 14/156,011

(22) Filed: Jan. 15, 2014

(65) Prior Publication Data

US 2014/0127054 A1 May 8, 2014

Related U.S. Application Data

(63) Continuation of application No. PCT/EP2012/002852, filed on Jul. 6, 2012.

(30) Foreign Application Priority Data

Jul. 15, 2011 (DE) ..... 10 2011 107 761

(51) Int. Cl.
*F04B 53/16* (2006.01)
*F04B 17/04* (2006.01)
(Continued)

(52) U.S. Cl.
CPC ..... *F04B 17/044* (2013.01); *F04B 13/00* (2013.01); *F04B 53/14* (2013.01); *F04B 53/143* (2013.01);
(Continued)

(58) Field of Classification Search
CPC .. F04B 7/04; F04B 13/00; F04B 53/14; F04B 17/044; F04B 53/162; F04B 53/144; F04B 53/16; F04B 53/143
(Continued)

(56) References Cited

U.S. PATENT DOCUMENTS 3,113,491 A * 12/1963 Borowka ..... F04B 53/14 384/279
3,194,447 A 7/1965 Brown
(Continued)

FOREIGN PATENT DOCUMENTS

DE 3102502 A1 * 8/1982 ..... F01B 1/0644
EP 1878920 A1 1/2008
(Continued)

OTHER PUBLICATIONS

International Search Report and Written Opinion dated Sep. 14, 2012 for International Application No. PCT/EP2012/002852. 10 Pages.

*Primary Examiner* — Dominick L Plakkoottam
*Assistant Examiner* — Philip Stimpert
(74) *Attorney, Agent, or Firm* — Eschweiler & Potashnik, LLC

(57) ABSTRACT

A metering pump enables simple fluid metering, has an extended service life, and is of compact construction. The metering pump includes a piston rod in operative connection with a control body which has a circumferential sealing zone, in that the internal circumference of the sealing cylinder radially surrounds the sealing zone. On the piston rod side, a compensating zone, which is at a greater radial distance from the sealing cylinder than the sealing zone, adjoins the sealing zone at least in portions, and in that the
(Continued)

control body, after passing beyond the control edge in the actuation direction of the actuator, at least largely severs the fluid connection.

18 Claims, 2 Drawing Sheets

(51) Int. Cl.
*F04B 13/00* (2006.01)
*F04B 53/14* (2006.01)

(52) U.S. Cl.
CPC ..... *F04B 53/144* (2013.01); *F04B 53/16* (2013.01); *F04B 53/162* (2013.01)

(58) Field of Classification Search
USPC ..... 417/490, 501
See application file for complete search history.

(56) References Cited

U.S. PATENT DOCUMENTS

| | | | | |
|---|---|---|---|---|
| 3,463,093 | A | 8/1969 | Pfeiffer et al. | |
| 4,881,687 | A * | 11/1989 | Ballu | B05B 9/0816 222/333 |
| 6,755,630 | B2 * | 6/2004 | Kim | F04B 39/102 417/501 |
| 7,621,726 | B2 * | 11/2009 | Bachner | F04B 7/04 417/417 |
| 7,661,936 | B2 * | 2/2010 | Reiner | B60T 8/4031 417/490 |
| 8,342,078 | B2 | 1/2013 | Neuner | |
| 8,388,323 | B2 | 3/2013 | Cooke | |
| 8,845,038 | B2 | 9/2014 | Hipp et al. | |
| 2005/0276710 | A1 | 12/2005 | Reiner | |
| 2008/0190988 | A1 * | 8/2008 | Pedicini | B25C 1/04 227/130 |

FOREIGN PATENT DOCUMENTS

| | | | |
|---|---|---|---|
| GB | 1024529 | A | 3/1966 |
| GB | 1189592 | A | 4/1970 |
| WO | 2007124873 | A1 | 11/2007 |

* cited by examiner

METERING PUMP

REFERENCE TO RELATED APPLICATIONS

This application is a continuation of International application number PCT/EP2012/002852, filed on Jul. 6, 2012, which claims priority to German application number 10 2011 107 761.1, filed on Jul. 15, 2011.

FIELD

The disclosure relates to a metering pump in accordance with the preamble of claim 1.

BACKGROUND

DE 10 2004 028 889 A1 shows a metering pump, comprising a sealing cylinder, a piston rod which can be moved axially in the sealing cylinder, an outlet valve housing which is arranged on the sealing cylinder on the outlet side, and an outlet valve body. At its outlet-side end, the sealing cylinder has an inwardly directed flange which has a radially flattened edge which faces the outlet valve housing and forms a valve seat for the valve body. The sealing cylinder forms and comprises a conveying space, a spring which is arranged in the conveying space being supported against the flange. The spring is supported at the other end on the piston rod and prestresses the piston rod counter to the conveying direction. On the inlet side, the cylinder element has axially running slots which form a fluidic connection from a pump space to the conveying space. The slots have a control edge which runs normally with respect to the movement axis of the piston rod and delimits the conveying space. The piston rod has a cylindrical projection on the outlet side, a circumferential sealing element being arranged on the projection. It is disadvantageous that the sealing element has high wear when the sealing element moves past the control edge and is in contact with the latter in the process. Furthermore, high pressure fluctuations are disadvantageously produced in the grooves, with the result that the piston rod experiences radially acting transverse forces and, as a result, high friction of the piston rod on the sealing cylinder is produced, as a result of which the service life of the pump is greatly restricted. Finally, the mass to be moved of the piston rod is great, since the diameter of the piston rod is adapted over its entire extent to the internal diameter of the sealing cylinder.

EP 1 878 920 A1 shows an electromagnetic metering pump having a coil which is wound on a coil former, a housing which supports the coil former, a core flange which is let into the housing and has an outlet channel, and a connection piece with an inlet channel, which connection piece is screwed into the housing opposite the core flange. The core flange has a hollow body which forms a sealing cylinder, has an approximately hollow-cylindrical shape, and penetrates the coil former approximately over the entire axial extent of the coil former. Furthermore, an actuator is provided comprising a ferromagnetic armature and a piston rod which is arranged in the ferromagnetic armature, the piston rod penetrating the hollow body of the core part, and the ferromagnetic armature being arranged in a pump space which is formed between the hollow body of the ferromagnetic core flange and the connection piece. A fluid channel which opens into a radial bore in the cylindrical section of the core part is provided between the hollow body of the ferromagnetic core flange and the coil former, it being possible for fluid which is to be conveyed from the pump space by a stroke movement of the armature to be pumped via the fluid channel and the radial bore into a conveying space which is arranged between the piston rod and the outlet channel. The fluid channel which surrounds the sealing cylinder is provided disadvantageously, which fluid channel prevents a compact overall design of the metering pump.

SUMMARY

In one embodiment of the disclosure a metering pump is disclosed which makes simple fluid metering possible, has an increased service life and is of compact configuration.

According to the disclosure, the metering pump has a pump drive having an axially displaceable actuator, to which a piston rod is connected. The piston rod is arranged concentrically with respect to a sealing cylinder which is advantageously arranged on the outlet side, and protrudes into the sealing cylinder at least when the actuator is actuated. The sealing cylinder has, on its inner circumference, at least one groove for fluidic connection between a pump space which accommodates the actuator and a conveying space which is arranged in the sealing cylinder. A simple fluidic connection is produced as a result, in which the fluid to be conveyed flows axially out of the pump space into the conveying space, with the result that the metering pump can advantageously be of compact configuration and can be manufactured inexpensively. On the outlet side, the groove has a control edge, which control edge delimits the conveying space in the axial direction of the metering pump. The piston rod is at least connected operatively to a control body, the control body having a circumferential sealing region. Here, the inner circumference of the sealing cylinder radially surrounds at least the sealing region of the control body. A calculable displacement of the fluid from the metering pump is advantageously achieved by interaction of the sealing region with the control edge of the sealing cylinder. In the case of an axial displacement of the actuator and therefore of the piston rod, the control body is also displaced on account of the operative connection, the control body disconnecting the fluidic connection between the conveying space and the pump space after moving over the control edge in the actuating direction of the actuator. In the case of the predominant disconnection of the fluidic connection, fluid leaks can occur laterally as a result of the play between the control body and the sealing cylinder, which play is configured for the movability of the control body in the sealing cylinder, at least a predominant part of the fluidic connection advantageously being disconnected. On the piston rod side, that is to say on that side of the sealing region which faces the piston rod, the sealing region is adjoined at least in sections by a compensation region which is spaced apart in the radial direction from the sealing cylinder further than from the sealing region. An excess fluid can advantageously flow away along the compensation region when the control edge is overtraveled by the sealing region. Furthermore, only a relatively small mass advantageously has to be moved during the stroke movement, with the result that the degree of efficiency of the pump is increased in general.

In one embodiment, the groove runs parallel to the movement direction of the piston rod, the movement direction of the piston rod corresponding to the actuating direction of the actuator. A particularly short overall design is achieved as a result. As an alternative, the groove can also be provided in a helical manner on the inner circumference of the sealing cylinder.

In one embodiment a web region is arranged adjacently with respect to the at least one groove, the inner radius of which corresponds to the inner radius of the conveying space. Circumferential guidance of the control body is advantageously achieved as a result. If a multiplicity of grooves are provided in the sealing cylinder, in each case one web region is arranged adjacently with respect to two grooves. The web region has a surface curvature which is of complementary configuration with respect to a curvature of the sealing region of the control body, the web region forming a guide for the control body.

In one embodiment of the metering pump, the control body is configured as a ball. A ball is advantageously simple to manufacture and advantageously has a uniform fluid displacement. Furthermore, the ball forms a linear sealing region which surrounds the ball at its maximum extent normally with respect to the movement axis. When the control edge is moved over with the sealing region, a pressure increase is produced as a result of the replenished fluid in the region upstream of the control edge. As a result of the linear sealing region, the compensation region which adjoins the sealing region can be reached by the fluid immediately after the control edge is moved over, with the result that the pressure increase is reduced in terms of time and amplitude. Furthermore, the wear of the sealing cylinder and control body is minimum on account of the linear sealing region.

In one embodiment the groove in the sealing cylinder has a transition region from a bottom of the groove toward the conveying space, an oblique or a rounded transition region advantageously being provided. For example, the course of the transition region can have a linearly or exponentially rising gradient. The transition region is expediently at an angle of from 30° to 60°, in one embodiment 45°, with respect to the bottom of the groove, and therefore forms a ramp u of the control edge. In contrast to a step, an abrupt airflow breakaway edge is thus avoided at the control edge before being moved over by the sealing region, as a result of which the fluid to be conveyed is conveyed more uniformly. Furthermore, pressure spikes are avoided during moving over of the control edge.

In one embodiment the maximum external diameter of the piston rod is smaller than the maximum external diameter of the control body. As a result, a relatively low mass is advantageously moved during a pump movement, with the result that less energy is required for the pump drive, and the mass moment of inertia which is produced is reduced. Furthermore, a larger pump space is thus provided, with the result that a greater quantity of fluid can be conveyed into the conveying space during pump operation.

In one embodiment the sealing cylinder is shaped primarily from a sintering material by sintering. Oxide ceramics may be used as sintering materials, such as aluminum oxide, magnesium oxide, zirconium oxide, titanium dioxide, aluminum titanate, mullite, lead zirconate titanate, dispersion ceramics such as $Al_2O_3$, $ZrO_2$, since the materials have a high resistance to the fluids to be conveyed, comprising gasoline fuels, diesel fuels and kerosene. As an alternative, $Si_3N_4$ or SiC can also be provided which can be manufactured in a manner which is extremely accurate with respect to the final contours. In one embodiment, the control body is sintered. Here, the sealing cylinder and/or the control body are produced from a sintering material. However, the sealing cylinder and the control body can also be produced from a plastic. The stated materials are resistant, in particular, to chemically aggressive media.

In one embodiment, the pump drive has a coil unit which is arranged outside the pump space, the pump space being delimited by an inlet part and an outlet part and being connected at the inlet part and the outlet part by an encasing section with a closed circumferential face. Here, the inlet part has an inlet channel and the outlet part has an outlet channel. In one embodiment the encasing section seals the pump space with respect to the coil unit. A simple separation between a chemically aggressive fluid and the components which drive the pump is thus advantageously provided. In one embodiment the encasing section is configured in one piece with either the inlet part or the outlet part. As a result, a pump part is provided which is particularly simple to assemble, can accommodate the movable parts of the pump and surrounds the pump space.

In one embodiment of the metering pump, the control body is prestressed by a spring counter to a conveying direction. Here, in the case of a loose connection between the control body and the piston rod, the spring is supported on the control body, as a result of which the control body is advantageously moved back with the piston rod. In one embodiment of the disclosure, the actuator is loaded and prestressed by the spring counter to a conveying direction. In the case of a fixed connection between the control body and the piston rod, the spring is advantageously supported on the actuator, as a result of which a spring which is supported on the control body can advantageously be avoided.

In one embodiment, the piston rod and the control body are configured in one piece. Here, the control body advantageously forms an extension of the piston rod. High stability of the piston rod is achieved as a result. Furthermore, in one embodiment the piston rod is guided by the sealing region of the control body on its circumference, as a result of which external shocks have a reduced influence on the running of the piston rod. Here, the operative connection can be loose bearing of the control body against the piston rod, but can also be a fixed material connection between the control body and the piston rod. The releasable fixed connection between the control body and the piston rod can also be provided, the connecting member then advantageously being provided. As an alternative, the control body and the piston rod can be two components which are produced separately and are connected fixedly to one another, as a result of which a multiplicity of compensation regions with complex geometries can advantageously be produced simply, such as ribs which run in the flow direction on the control body or the piston rod. Furthermore, as an alternative, the control body and the piston rod can be produced as separate parts which are displaced together in the pump direction, either two springs then being provided for the individual prestressing of piston rod and control body or one spring being provided for the common prestressing of piston rod and control body at the same time.

In one embodiment the piston rod has at least one groove, which groove opens from the pump space into the compensation region. Here, the groove expediently runs parallel to a longitudinal extent of the piston rod. The mass to be moved in the metering pump is reduced by the groove in the piston rod, and at the same time a greater fluidic connection between the conveying space and the pump space is produced. In one embodiment the groove of the piston rod is arranged opposite the groove in the sealing cylinder, with the result that a common flow channel for the fluidic connection is formed. As a result, a convex surface in the flow channel is advantageously avoided, which results in more uniform pressure distribution and therefore friction on the surface of the flow channel and, as a result, the formation of bubbles is advantageously reduced in the flow channel.

In one embodiment the pump drive is an electromagnetic drive with a coil which surrounds the pump space, an armature of the actuator being formed from a ferromagnetic material, and it being possible for the armature to be moved in the conveying direction, as an alternative counter to the conveying direction, by way of current application to the coil.

BRIEF DESCRIPTION OF THE DRAWINGS

Further advantages, properties and developments of the disclosure result from the following description of example embodiments and from the dependent claims.

DETAILED DESCRIPTION

Figure 1:
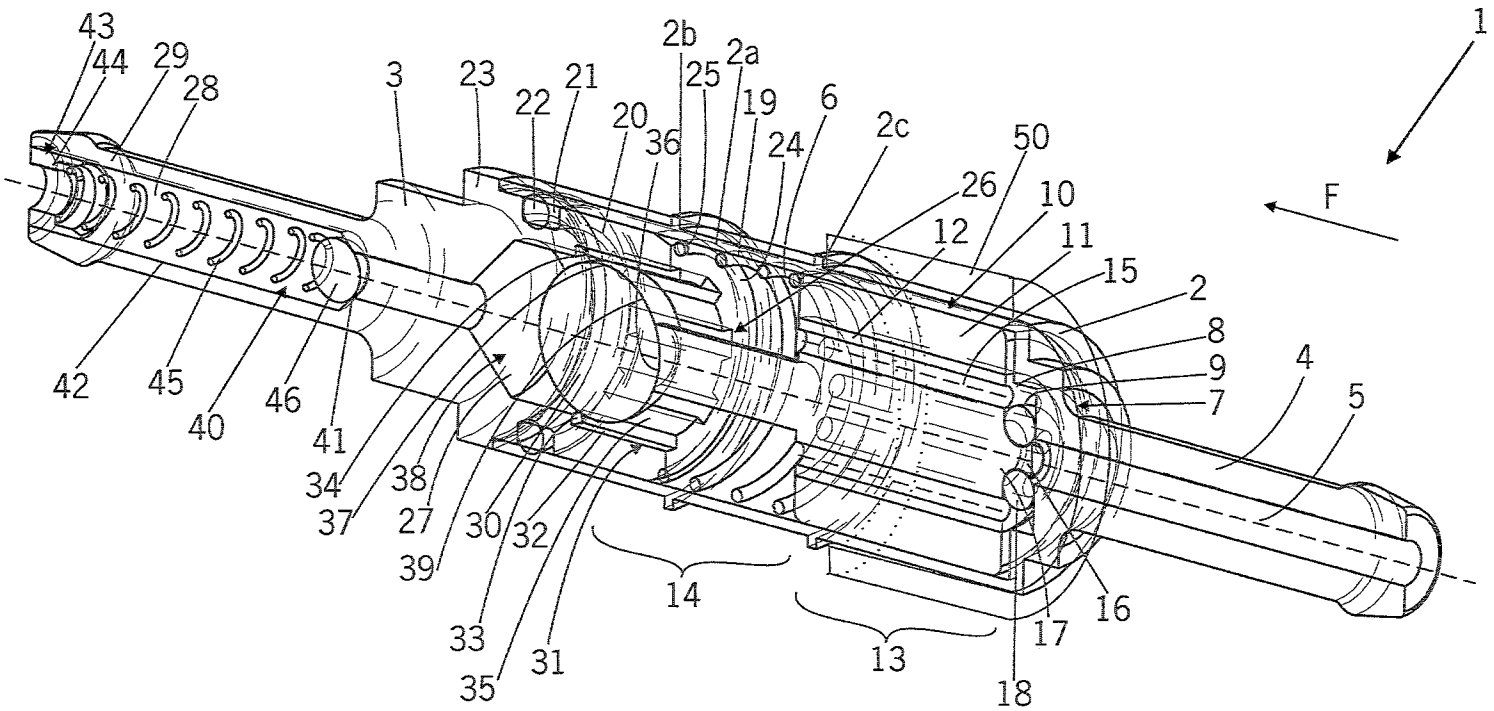
FIG. 1 shows a first example embodiment of a metering pump according to the disclosure with a sealing cylinder and with a control body which is separate from the piston rod.

FIG. 1 shows a first exemplary embodiment of a metering pump 1 which is configured as a reciprocating piston pump, with an inlet part 2 which forms a housing and an outlet part 3 which is pushed longitudinally into the inlet part 2. The inlet part 2 and the outlet part 3 are rotational bodies and are oriented concentrically with respect to one another and form a common axis A, to which axis A a conveying direction F of the pump 1 runs from the inlet part 2 to the outlet part 3. On the inlet side, the inlet part 2 has an inlet connector 4 with an inlet channel 5. For connection to a pipeline system, the inlet connector 4 has a mouthpiece which thickens the inlet connector 4. In an outlet-side encasing section 2*a*, the inlet part 2 is configured as a hollow cylinder, in the interior of which a cylindrical pump space 6 is arranged. FIG. 1 shows a schematic representation of an electromagnetic coil unit 50 of a pump drive, whereby the coil unit is arranged outside the inlet part 2 and is formed from a coil and a coil former, which are not shown on account of improved clarity. The encasing section 2*a* of the inlet part 2 has outer flanges 2*b*, 2*c* which delimit approximately a middle third and serve as bearing face for parts of the pump drive which guide a magnetic field. An air gap is advantageously arranged between the two flanges 2*b*, 2*c*. Furthermore, the inlet part 2 and the outlet part 3 have a step 3*d*, 2*d* which serves as bearing face for ferromagnetic yoke shims (not shown) of the pump drive.

The inlet channel 5 opens via a cylindrical opening 7 into the cylindrical pump space 6 which is arranged in the inlet part 2, a diameter of the pump space 6 being greater than a diameter of the inlet channel 5. The opening 7 of the inlet channel 5 in the pump space 6 is surrounded here by a cylindrical step 8 which protrudes into the pump space 6, the result of which is a sealing region 9 within the cylindrical step 8. Here, the diameter of the sealing region 9 is approximately a mean value of the diameter of the pump space 6 and the diameter of the inlet channel 5.

An actuator 10 is arranged in the pump space 6, which actuator 10 comprises a ferromagnetic armature 11 and a non-magnetic piston rod 12 which is connected fixedly to the ferromagnetic armature 11. The ferromagnetic armature 11 and the piston rod 12 are rotational bodies which are arranged concentrically around the axis A, the actuator 10 being shown in a neutral position in FIG. 1. The ferromagnetic armature 11 has an external diameter which is slightly smaller than the internal diameter of the pump space 6, with the result that an almost friction-free axial sliding of the actuator 10 in the pump space 6 is made possible. The piston rod 12 has an armature region 13 which is connected fixedly to the ferromagnetic armature 11 and a rod region 14 which points toward the outlet side of the metering pump 1. Here, the armature region 13 of the piston rod 12 has a diameter which is approximately twice as large as the rod region 14. The armature region 13 therefore has a shoulder region which is stepped with respect to the rod region 14 and in which a plurality of bores 15 which run parallel to the axis A connect the sealing region 9 to that section of the pump space 6 which is arranged around the rod region 14. On the inlet side, the piston rod 12 has an axially projecting projection 16, which projection 16 has a surface 17 which is curved concavely in the direction of the axis A, a sealing element 18 which is configured as an O-ring being arranged around the projection 16 and, in the neutral position, separating the sealing region 9 from the inlet channel 4 in a fluid-tight manner.

A region of the outlet part 3 which is pushed into the pump space 6 is configured as a sealing cylinder 20, the external diameter of the sealing cylinder 20 corresponding to the internal diameter of the cylindrical inlet part 2. On the outside, the sealing cylinder 20 has a circumferential groove 21, into which an O-ring 22 is received. The circumferential groove 21 is surrounded toward the outside by the cylindrical inlet part 2, with the result that the pump space 6 is sealed against the surroundings. Centrally on its outer side, the outlet part 3 has a flange 23 which delimits the sealing cylinder, the flange 23 serving as a rest for the cylindrical inlet part 2 which surrounds the outlet part 3 or the sealing cylinder, with the result that pushing in of the outlet part 3 with the sealing cylinder 20 in the inlet part 2 is limited.

A helical spring 25 is arranged in the pump space 6 between an end side 24 of the sealing cylinder 20, which end side 24 faces the actuator 10, and the armature 11 of the actuator 10. The sealing cylinder 20 has a substantially cylindrical inner region 26, which inner region 26 extends in the axial direction from the end side 24 as far as a conical outlet opening 27 of an outlet channel 28 of the metering pump 1. Here, the outlet channel 28 is arranged in an outlet connector 29 of the outlet part 3. A spherical control body 30 is arranged in the cylindrical inner region 26 of the outlet part 3, the external diameter of which control body 30 corresponds to the internal diameter of the inner region 26. Here, a sealing region 37 is defined as the linearly resulting contact area 37 of the control body 30 with an inner face of the inner region 26. Here, the surface of the control body 30 forms a compensation region 39 behind the sealing region 37. The compensation region 39 is further away from the inner face of the sealing cylinder 20 here than the sealing region 37. As a result, an enlarged fluid gap between the control body 30 and the sealing cylinder 20 is formed behind the sealing region 37.

A multiplicity of grooves 31 with a trapezoidal, almost rectangular cross section are let circumferentially into the inner face of the inner region 26, which grooves 31 extend parallel to the axis A and approximately over half of the axial extent of the inner region 26. Here, each groove bottom 32 of each groove 31 is at a greater spacing from the axis A than the inner face of the inner region 26. Here, an outlet-side end wall 33 of each groove 31 forms a control edge 34 of the metering pump 1 at the transition to the inner face of the inner region 26. In each case one web 35 is arranged between in each case two adjacent grooves 31, the webs 35 being part of the inner face of the inner region 26 and thus being in contact with the sealing region 37 of the control body 30. On its outlet-side end side 36, the piston rod 12 has a concave curvature which is adapted as a dome to the ball contour of the control body, the end side 36 being connected fixedly to the control body 30. The space between the outlet channel 28 and the control edge 34 is defined as a conveying space 38.

An outlet valve 40 is arranged in the outlet channel 28, a conical valve seat 41 which faces in the conveying direction being arranged in an inner wall 42 of the outlet channel 28. An insert element 43 which has a projection 44 which protrudes into the outlet channel 28 is arranged in the outlet channel 28 opposite the valve seat 41. Here, a valve spring 45 which is arranged between the insert element 43 and the valve seat 41 and is supported at one end on the projection 44 prestresses an outlet valve body 46 counter to the conveying direction F.

The metering pump 1 functions as follows:

In the position which is shown in FIG. 1, the metering pump 1 is situated in a neutral position. Here, the pump drive (not shown) does not exert any force on the actuator 10, with the result that the actuator 10 is loaded by the prestress of the spring 25 counter to the conveying direction F of the metering pump 1 with the sealing element 18 to the inlet channel 5 and separates the inlet channel 5 from the sealing space 9 and the pump space 6 which is otherwise fluidically connected to the sealing space 9 by the bores 15. When the ferromagnetic armature 11 is excited, the actuator 10 is displaced counter to the prestress of the spring 25 in the conveying direction F by application of current to the coil, the control body 30 being moved with the linear sealing region 37 toward the control edge 34. Here, fluid circulates between the pump space 6 and the conveying space 38 through the grooves 31 past the control body 30, fluid which is situated in the region of the compensation region 39 of the control body 30 also being sucked or pressed into the groove 31. As long as the fluid connection exists via the grooves 31 between the pump space 6 and the conveying space 38, the fluid can escape during the advancing of the control body 30 and the piston rod 12, with the result that no fluid passes via the outlet-side non-return valve 46, 41 into the outlet. At the same time, the sealing region 9 opens on the inlet side, the sealing element 18 rising up from the inlet channel 5 and thus making it possible for fluid to flow in from the inlet channel 5 into the pump space 6 via the sealing space 9 and the bores 15.

As soon as the control body 30 moves with the linear sealing region 37 over the control edge 34, the fluid connection which exists in the grooves 31 from the pump space 6 into the conveying space 37 is interrupted. The control body 30 therefore brakes the fluidic connection completely, at any rate completely apart from a very small slip (approximately 98%) and at any rate at least predominantly. If the actuator 10 and therefore the control body 30 are moved further in the conveying direction, the fluid which is situated in the conveying space 38 is pressed counter to the prestress of the outlet valve spring 45 out of the conveying space 38 into the outlet channel 28. As a result of the defined interruption and the defined stroke, an accurately metered fluid quantity is ejected in the case of a complete stroke, with the result that the metering pump 1 can be controlled readily and reliably.

As a result of the sudden interruption of the fluidic connection between the conveying space 38 and the pump space 6, a pressure increase is produced by way of the fluid which is replenished by the actuator 10 in a region behind the sealing region 37 of the control body 30. As a result of the enlargement of the cross-sectional area of the space in the region of the compensation region 39, an expansion space is advantageously available for the fluid, into which expansion space the fluid can flow or expand upon disconnection of the fluidic connection. Furthermore, the fluid can pass through the bores 15 in the piston rod 12 out of the pump space 6 into the sealing space 9, with the result that partial pressure equalization in the pump space 6 is also possible as a result. In particular after renewed moving over of the control edge 34 during a return stroke under the prestress of the spring 25, the fluidic connection between the conveying space 38 and the pump space 6 is re-established, and the negative pressure which is produced during the return stroke in the region of the conveying space 38 is filled again via a replenishing fluid through the grooves 31, as long as the actuator 10 has not yet assumed its sealing starting position again.

The metering pump 1 is advantageously simple to assemble. The actuator 10 with the attached control body 30 is pushed into the inlet part 2. Subsequently, the spring 25 around the control body 30 is inserted into the cylindrical pump space 6 until it comes into contact on the actuator 10. Finally, the outlet part 3 with the outer seals 22 and the outlet valve 40 is pushed into the inlet part 2 until the flange 23 bears against the inlet part 2.

Figure 2:
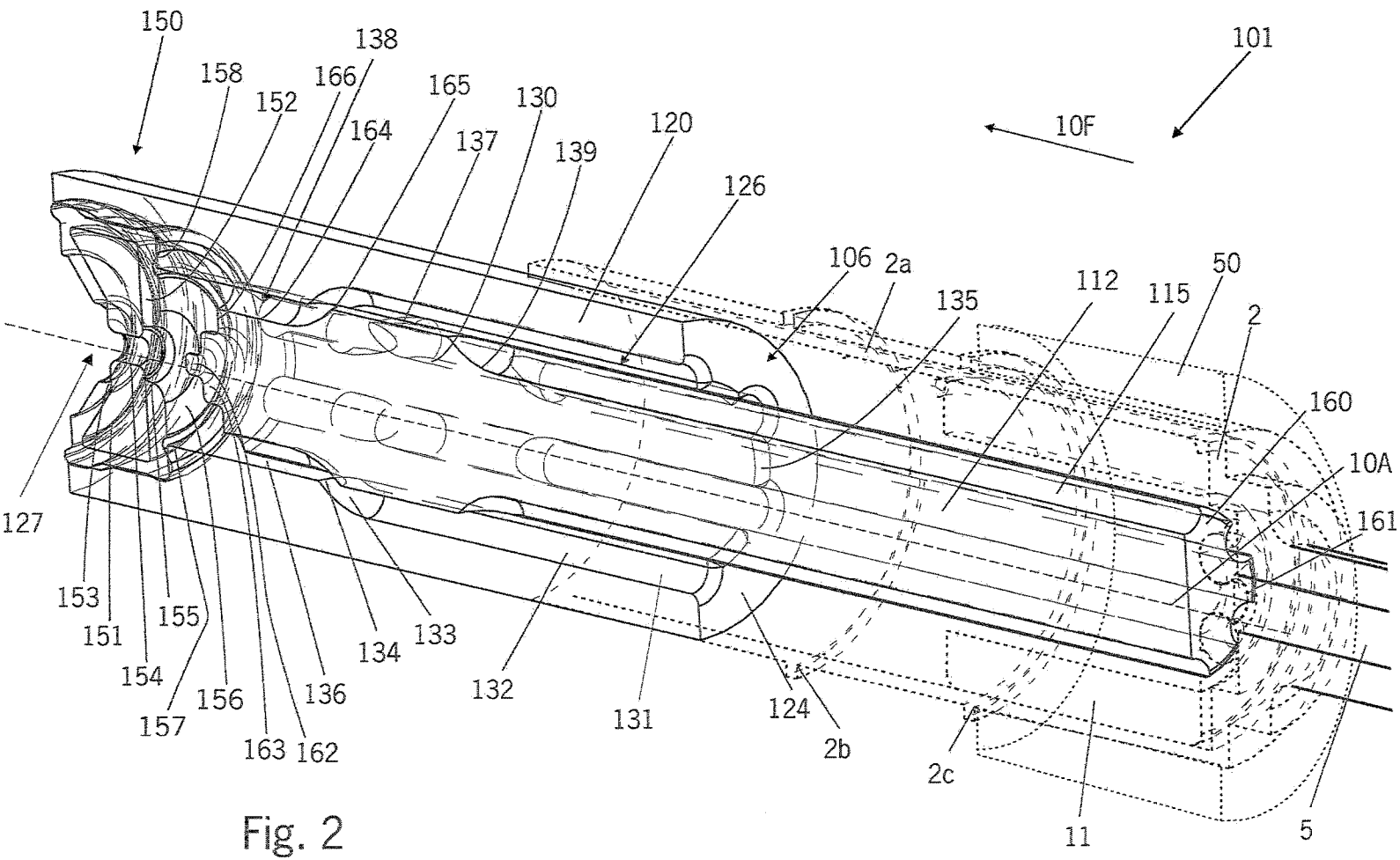
FIG. 2 shows a second example embodiment of a metering pump according to the disclosure with a sealing cylinder and with a control body which is connected to the piston rod.

FIG. 2 shows a detail of a pump space 106 of a second example embodiment of a metering pump 101, the designations of identical or similar components having been incremented by 100. Parts which are not described correspond to the parts of the first example embodiment according to FIG. 1.

A piston rod 112 which is arranged in the pump space 106 is configured so as to be in one piece with a control body 130 and sintered from a ceramic such as $Al_2O_3$, the control body 130 representing an extension of the piston rod 112. Here, the piston rod 112 is guided with the control body 130 in a cylindrical sealing cylinder 120 in a movable manner along an axis 10A which is formed by the cylindrical sealing cylinder 120. Here, a conveying direction 10F of the metering pump 101 runs parallel to the axis 10A from the pump space 106 in the direction of the sealing cylinder 120.

On the outlet side, an opening element 150 is let into the sealing cylinder 120. The opening element 150 comprises a metal core 151 and a plastic sheath 152 which surrounds the metal core 151 on the outside and on the inlet and outlet side, and is configured as a rotational body. Here, the metal core 151 protrudes further in the direction of the axis 10A than the plastic sheath 152. The opening element 150 forms a stepped opening 127 which is directed toward the piston rod 112, a cylindrical outlet bore 153, which delimits to the inside and defines an inner first step 154, being arranged in the metal core 151. Since the metal core 151 protrudes further to the inside than the plastic sheath 152, the plastic sheath 152 forms a second step 155 which is situated further to the outside with respect to the metal core 151. The plastic sheath 152 has an end side 156 which faces the piston rod 112, is delimited on the inside by the second step 155 and assumes an undulating shape in an outer region 157, the outer region 157 being calked with an inwardly protruding shoulder 158 of the sealing cylinder 120, which shoulder 158 points in the outlet-side direction.

On its surface, the piston rod 112 has a multiplicity of semicircular circumferential grooves 115 which extend from an inlet-side end 160 of the piston rod 112 as far as the control body 130 and, in a compensation region 139 which rises exponentially in the conveying direction 10F, merge into a cylindrical sealing region 137 of the control body 130. The sealing region has an axial extent and therefore corresponds to a cylindrical circumferential face as control body 130 which is of circumferential configuration. Between two circumferential grooves 115, the piston rod 112 has webs 161, the external diameter of which corresponds to an external diameter of the sealing region 137. On its outlet-side conveying end side 166, the piston rod 112 or the control body 130 has a cylindrical projection 162, from which a cylindrical step 163 protrudes, the cylindrical projection 162 having a diameter which corresponds to an internal diameter of the outlet bore 153 in the metal core 151 of the opening element 150. An external diameter of the cylinder step 163 corresponds to an internal diameter of the second step 155 of the plastic sheath 152, with the result that the piston rod 112 or the control body 130 is of complementary configuration with respect to the outlet opening 127. The external diameter of an output-side conveying region 164 of the control body 130 is smaller than the external diameter of the sealing region 137, a funnel-shaped transition region 165 being formed between the sealing region 137 and the conveying region 164.

By way of its inner faces, the sealing cylinder 120 defines an inner region 126 which extends from an inlet-side end side 124 as far as the outlet opening 127, semicircular grooves 131 being arranged starting on the end side 124 as far as approximately two thirds of the longitudinal extent of the inner region 126. An outlet-side end wall 133 of the grooves 131 runs substantially exponentially in the conveying direction 10F and normally with respect to the conveying direction 10F, a parabolic control edge 134 being formed between the inner face of the inner region 136 and the end wall 133, the vertex of which control edge 134 points in the outlet direction. The space which lies on the outlet side in front of the vertex of the control edge 134 is defined as conveying space 138.

The number of grooves 131 corresponds to the number of circumferential grooves 115 of the piston rod 112, the grooves 131 being arranged opposite the circumferential grooves 115, which results in a fully circular tube. Webs 135 are arranged between two grooves 131, the webs 135 being part of the inner face of the inner region 126 and thus being in contact with the control body 130 and the piston rod 112 and guiding them in a sliding manner.

The second example embodiment functions as follows:

If the piston rod 112 and therefore the control body 130 are moved in the conveying direction, the sealing region 137 moves over the control edge 134 and, as a result, disconnects a fluid connection between the conveying space 138 and the pump space 106. The fluid connection is closed gradually on account of the parabolic shape of the control edge 134, with the result that a pronounced pressure increase in a region which is connected to the pump space 106 is reduced near the control edge 134. Furthermore, fluid can flow out of the region which is arranged between the sealing region 137 and a groove bottom 132 via the compensation region 139 of the control body, and can thus relieve pressure.

A further movement of the control body 130 presses the fluid which is situated in the conveying space 138 into the outlet opening 127, particularly high displacement of the fluid taking place on account of the conveying end face which runs substantially perpendicularly with respect to the conveying direction 10F. The explanations with respect to FIG. 1 can be applied correspondingly for details.

FIG. 2 does not show an armature which surrounds the piston rod 112, semicircular corresponding bores which in one embodiment are of complementary configuration with respect to the semicircular circumferential grooves 115 being arranged in the armature, which corresponding bores are arranged opposite the circumferential grooves 115 and, in an analogous manner to the grooves 131, form fully circular inlet tubes with the circumferential grooves 115. On account of the continuous circumferential grooves 115, the inlet tubes are at the same spacing from the axis 10A as the tubes in the region of the sealing cylinder 120, with the result that friction losses of the metering pump are advantageously reduced on account of reduced obstacles in the flow path of the fluid.

The invention claimed is:

1. A metering pump, comprising a pump drive having an axially displaceable actuator, to which a piston rod is connected; and a sealing cylinder which is arranged concentrically with respect to the piston rod, the sealing cylinder having, on its inner circumference, at least one groove for fluidic connection between a pump space which accommodates the actuator and a conveying space which is provided in the sealing cylinder, wherein a control edge of the groove delimits the conveying space, wherein the piston rod is operatively connected to a control body which has a circumferential sealing region, wherein the circumferential sealing region is defined by a contact area of the control body with the inner circumference of the sealing cylinder, wherein the inner circumference of the sealing cylinder surrounds the circumferential sealing region radially, wherein the circumferential sealing region extends linearly along an axial direction of the metering pump, wherein, on a piston-rod side, a compensation region adjoins the circumferential sealing region at least in sections of an outer circumference of the control body, wherein the compensation region is spaced apart radially from the sealing cylinder further than the sealing region, and wherein the compensation region extends radially inward from the outer circumference of the control body, and wherein the circumferential sealing region of the control body disconnects the fluidic connection at least predominantly after moving over the control edge in the axial direction.

2. The metering pump as claimed in claim 1, wherein the control body and the piston rod are configured in one piece.

3. The metering pump as claimed in claim 1, wherein the at least one groove runs parallel to the axial direction, and wherein at least one web region is provided adjacently with respect to the at least one groove, wherein the internal diameter of the web region corresponds to the internal diameter of the conveying space.

4. The metering pump as claimed in claim 1, wherein the at least one groove comprises a transition region from a bottom of the at least one groove toward the conveying space.

5. The metering pump as claimed in claim 1, wherein the maximum external diameter of the piston rod is smaller than the maximum external diameter of the control body.

6. The metering pump as claimed in claim 1, wherein at least one of the sealing cylinder and the control body is produced from a material selected from the group consisting of a sintering material and a plastic.

7. The metering pump as claimed in claim 1, wherein the pump space is delimited by an inlet part with an inlet channel and an outlet part with an outlet channel, and wherein an encasing section with a closed circumferential face is connected at the inlet part and the outlet part.

8. The metering pump as claimed in claim 7, wherein the pump drive has a coil unit which is arranged outside the pump space, and wherein the encasing section seals the pump space with respect to the coil unit.

9. The metering pump as claimed in claim 7, wherein the encasing section is configured in one piece with either one of the inlet part and the outlet part.

10. The metering pump as claimed in claim 1, further comprising a spring that prestresses the control body and the actuator along the axial direction.

11. The metering pump as claimed in claim 1, wherein the piston rod has grooves which run parallel to the axial direction.

12. The metering pump as claimed in claim 1, wherein the actuator comprises a ferromagnetic armature.

13. The metering pump as claimed in claim 12, wherein the ferromagnetic armature is operationally coupled to the piston rod.

14. The metering pump as claimed in claim 1, wherein the compensation region comprises a surface that is curved in the axial direction.

15. A metering pump, comprising:

a pump drive having an axially displaceable actuator, to which a piston rod is connected; and a sealing cylinder which is arranged concentrically with respect to the piston rod, the sealing cylinder having, on its inner circumference, at least one groove for fluidic connection between a pump space which accommodates the actuator and a conveying space which is provided in the sealing cylinder, wherein a control edge of the at least one groove delimits the conveying space, wherein the piston rod is operatively connected to a control body which has a circumferential sealing region, wherein the circumferential sealing region is defined by a contact area of the control body with the inner circumference of the sealing cylinder, wherein the inner circumference of the sealing cylinder surrounds the circumferential sealing region radially, wherein the circumferential sealing region extends linearly along an axial direction of the metering pump, wherein, on a piston-rod side, a surface of the control body forms a compensation region which is spaced apart radially from the sealing cylinder further than the circumferential sealing region and axially adjoins the circumferential sealing region at least in sections of an outer circumference of the control body, wherein the compensation region extends radially inward from the outer circumference of the control body, wherein an enlarged fluid gap between the control body and the sealing cylinder is formed on the piston-rod side, and wherein the control body disconnects the fluidic connection at least predominantly after moving over the control edge in the actuating direction.

16. The metering pump as claimed in claim 15, wherein the piston rod has one or more piston rod grooves which run parallel to the axial direction.

17. The metering pump as claimed in claim 15, wherein the compensation region has a depth that continuously increases in the axial direction from the outer circumference of the control body.

18. A metering pump, comprising:

a pump drive having an axially displaceable actuator, to which a piston rod is connected; and a sealing cylinder which is arranged concentrically with respect to the piston rod, the sealing cylinder having, on its inner circumference, at least one groove for fluidic connection between a pump space which accommodates the actuator and a conveying space which is provided in the sealing cylinder, wherein a control edge of the groove delimits the conveying space, wherein the piston rod is operatively connected to a control body which has a circumferential sealing region, wherein the circumferential sealing region is defined by a contact area of the control body with the inner circumference of the sealing cylinder, wherein the inner circumference of the sealing cylinder surrounds the circumferential sealing region radially, wherein the circumferential sealing region extends linearly along an axial direction of the metering pump, wherein, on a piston-rod side, a surface of the control body forms a compensation region which is spaced apart radially from the sealing cylinder further than the circumferential sealing region and axially adjoins the circumferential sealing region at least in sections of an outer circumference of the control body, wherein the surface of the control body that forms the compensation region is curved in the axial direction of the metering pump and extends radially inward from the outer circumference of the control body, wherein an enlarged fluid gap between the control body and the sealing cylinder is formed on the piston-rod side, and wherein the control body disconnects the fluidic connection at least predominantly after moving over the control edge in the actuating direction.

* * * * *